US005992851A

United States Patent [19]

Ajtai

[11] Patent Number: 5,992,851

[45] Date of Patent: Nov. 30, 1999

[54] TOWERS OF HANOI GAME

[76] Inventor: Miklos Ajtai, 16307 Roseleaf La., Los Gatos, Calif. 95032

[21] Appl. No.: 09/172,707

[22] Filed: Oct. 13, 1998

[51] Int. Cl.[6] ..... A63F 9/06

[52] U.S. Cl. ..... 273/153 S

[58] Field of Search ..... 273/153 R, 153 S, 273/156

[56] References Cited

U.S. PATENT DOCUMENTS

| | | | |
|---|---|---|---|
| 3,637,215 | 1/1972 | Keister . | |
| 3,637,216 | 1/1972 | Keister . | |
| 3,637,217 | 1/1972 | Kent . | |
| 3,841,638 | 10/1974 | Sinden . | |
| 4,065,132 | 12/1977 | Giakas . | |
| 4,138,115 | 2/1979 | Gans . | |
| 4,354,682 | 10/1982 | Vcala . | |
| 4,415,158 | 11/1983 | Engel . | |
| 4,580,783 | 4/1986 | Cohan . | |
| 4,723,776 | 2/1988 | Bean . | |
| 4,836,540 | 6/1989 | Bean . | |
| 4,919,427 | 4/1990 | Keidar et al. . | |
| 4,978,126 | 12/1990 | Morosow et al. . | |
| 5,108,100 | 4/1992 | Essebaggers et al. . | |
| 5,116,052 | 5/1992 | Pop | 273/153 S |
| 5,135,225 | 8/1992 | Pszotka et al. . | |
| 5,344,147 | 9/1994 | Lee . | |

FOREIGN PATENT DOCUMENTS

| | | | |
|---|---|---|---|
| 2236955 | 4/1991 | United Kingdom | 273/153 S |

*Primary Examiner*—Raleigh W. Chiu

*Attorney, Agent, or Firm*—Blakely, Sokoloff, Taylor & Zafman LLP

[57] ABSTRACT

A compact mechanical toy is provided. The toy is a multi-sided game including multiple sides and a plurality of moveable pieces. The toy includes a first part including one side having a cavity shaped to fit any one of the plurality moveable pieces at one time. The toy further includes a second part rotatably coupled to the first part, the second part including a complex cavity in each of the multiple sides, the complex cavity shaped to fit each of the plurality of moveable pieces in a certain order. The object of the game is to move each of the plurality of pieces from a first side in the second part to a second side in the second part.

20 Claims, 13 Drawing Sheets

TOWERS OF HANOI GAME

FIELD OF THE INVENTION

The present invention relates to mathematical games, and more specifically, to a Towers of Hanoi game.

BACKGROUND

The game called the Towers of Hanoi was invented by the French mathematician Edouard Lucas in 1883 and since then it has been both a popular puzzle and a well-known mathematical problem that is an excellent illustration of the general concept of recursion. This puzzle is known by most mathematicians and a very large number of people who like either puzzles or elementary mathematical problems.

The original Towers of Hanoi puzzle is illustrated in FIG. 1. The Towers of Hanoi consists of seven disks 110A–110G of different sizes which during the solution of the puzzle are arranged in three stacks 120, 130, 140. When the game starts, all of the disks 110A–110G are in a single stack 120 arranged by size, so that largest disk 110G is at the bottom of the stack 120. The goal of the puzzle is to move all of the disks 110A–110G to the third stack 140. This must be achieved by observing the following rules:

(1) one move consists of taking the topmost disk from a stack and putting it on another stack—either starting a new stack or placing it on top of other disks on the second stack.

(2) the move described in (1) can be performed only if all of the disks in the second stack are larger than the disk being moved—i.e. a larger disk can never be placed on top of a smaller disk.

The actual realization of the puzzle usually consists of a base 150, three pegs 120, 130, 140, and disks 110A–110G that can be put on the pegs 120, 130, 140. Puzzles constructed this way are available in some toy stores.

Unlike other mechanical puzzles, like Rubik's cube, or Lloyd's 15, this puzzle requires the player to observe some rules, which are not guaranteed by the mechanics of the puzzle. It is possible to cheat or make mistakes and get to the solution in an easier way, without destroying or taking apart the mechanical structure of the puzzle. This is a disadvantage, since some of the potential players, e.g. children do not like to memorize and observe rules. Some of the attraction of mechanical puzzles is the mechanical structure that forces the rules on the player. This is missing in the prior art implementations of this game.

SUMMARY AND OBJECTS OF THE INVENTION

It is an object of this invention to provide a mechanical game that inherently follows rules of the game.

It is an object of this invention to provide a game that is self-contained.

It is an object of this invention to provide a game that has no loose parts.

The game comprises a body having a plurality of sides. There are a plurality of pieces disposed within the body. It is object of the game to move all of the pieces from one side of the body to another side of the body. The game automatically implements rules of a Tower of Hanoi game.

Other objects, features, and advantages of the present invention will be apparent from the accompanying drawings and from the detailed description that follows below.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION

A Towers of Hanoi game is described. The game includes three or more sides which correspond to the pegs, or stacks of the game. A number of elements, corresponding to the disks, are movably coupled into the sides. The object of the game is to move these elements from a first side to a second side. The rules of the Towers of Hanoi game—i.e. that only one disk may be moved at one time, and that no larger disk may be placed on a smaller disk—are inherently embodied in the game itself. Therefore, no knowledge of these rules is needed to play the game.

The goal of this invention is to present the Towers of Hanoi puzzle in a form where the shortcomings of the original game are eliminated. Thus, the puzzle is a single mechanical structure and the player has to know only the goal of the puzzle and does not have to remember any rules. This mechanical structure can be used for different variants of the original "Towers of Hanoi" game.

Figure 1:
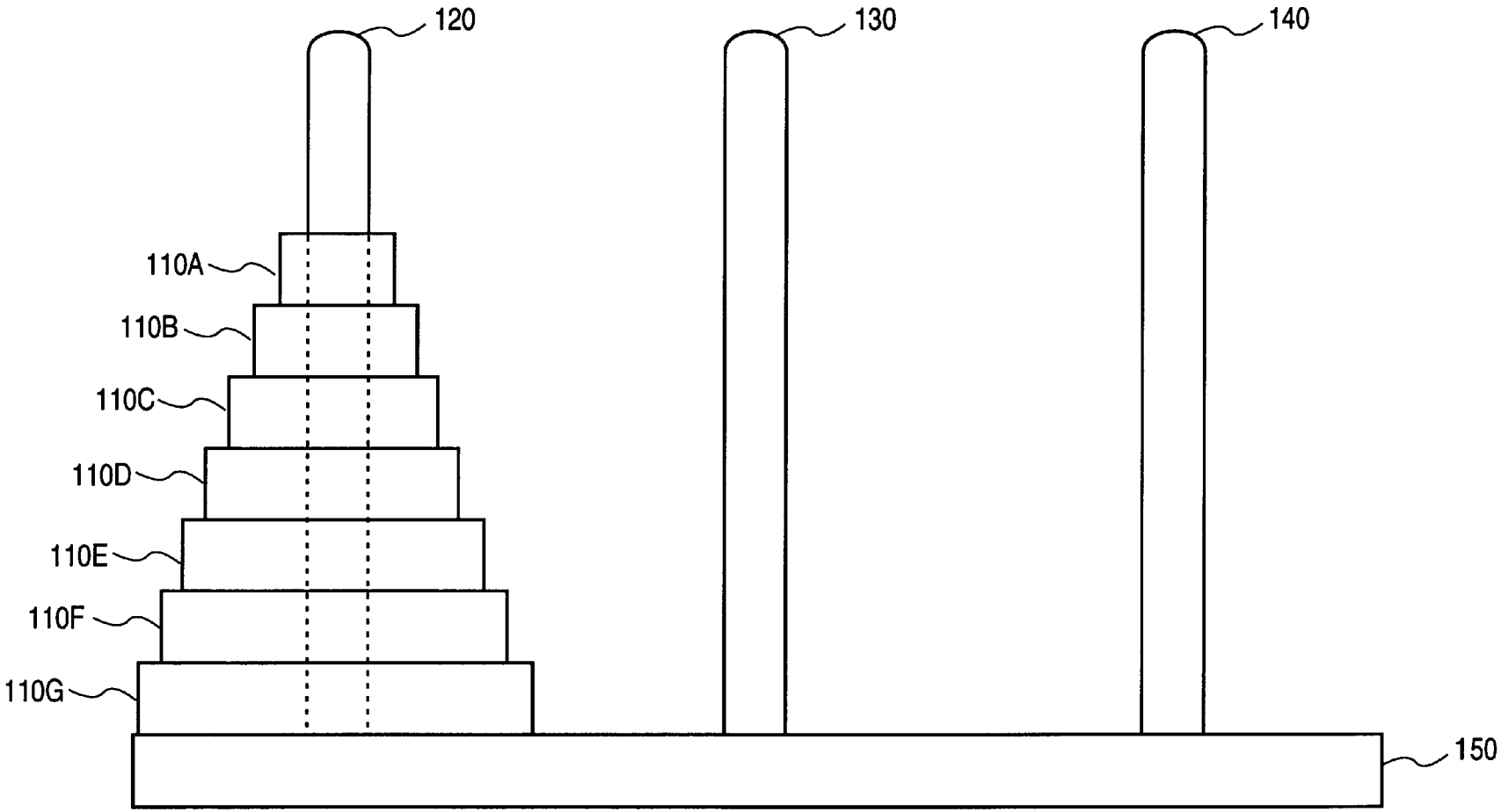
FIG. 1 (PRIOR ART)
FIG. 1 is a prior art Towers of Hanoi game.
Figure 2:
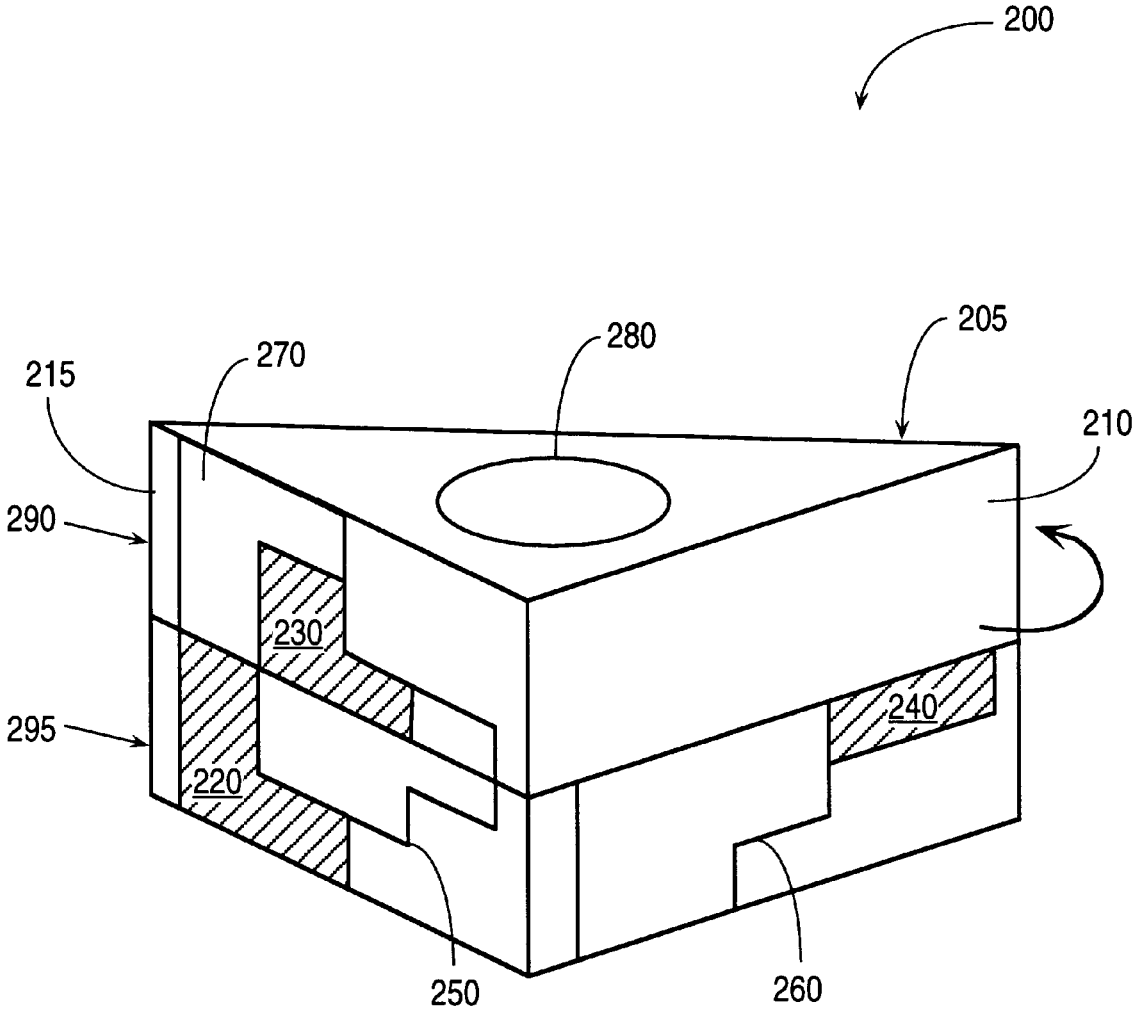
FIG. 2 is a perspective view of one embodiment of the Towers of Hanoi game according to the present invention.

FIG. 2 illustrates one embodiment of the present invention. FIG. 2 illustrates a perspective view of a three sided Towers of Hanoi (ToH) game, with three moveable elements. These elements, or pieces, correspond to the disks of the original ToH game. For simplicity and clarity, these movable elements will be referred to as disks hereafter.

The game 200 has three sides 205, 210, 215. For one embodiment, each side is rectangular. The three sides form the side panels of a five sided body, having a triangular top and bottom. The sides 205, 210, 215 are split into an upper part 290 and a lower part 295 that may be rotated with respect to each other. The lower part 295 of each side 205, 210, 215 has a substantially identical configuration. For one embodiment, each side of the lower part 295 is numbered to make it easier to remember the starting and ending positions.

Each lower part 295 includes a cavity 250, 260. The cavity is shaped to receive disks 220, 230, 240. Generally, the ToH game includes more than three disks, however, for simplicity, only three disks are illustrated here. For one embodiment, the game includes seven disks of graduated sizes. These disks are referred to ask going from "largest" to "smallest". However, in some embodiments, the relative sizes of the disks do not reflect this. The numbers on the disks, as in FIG. 3, may be used in such configurations to indicate what the largest and smallest disks are.

The disks 220, 230, 240 may all be placed into any one of the cavities 250, 260 (and 265, on the third side, not shown) in order of decreasing size, with the largest disk at the bottom, and the smallest on top. For one embodiment, the shape of the disks is an L shape. For one embodiment the smallest disk has a rectangular shape. Alternatively, all of the disks may be L-shaped. For another embodiment different shape disks may be used. However, the limitation that no larger disk may be placed on a smaller disk is implemented regardless of disk shape. When placed into a single cavity 250, the disks nest next to each other. For one embodiment, the top of each disk 220–240 is at the same level, and the bottom of each disk extends to a different level.

The upper part 290 also includes a cavity 270. For one embodiment, only one of the three sides 205, 210, 215 of the upper part 290 includes a cavity 270. For another embodiment, more than one of the sides of the upper part 290 may include a cavity. The cavity 270 of the upper part 290 is a complex cavity 270 designed to fit any one of the disks 220, 230, 240 at a time. The top disk in the lower part may be moved to a different bottom cavity by moving the disk into the top cavity 270, and rotating the upper part 290 with respect to the lower part 295. For another embodiment, multiple disks may fit into the complex cavity 270. For example, the complex cavity 270 may fit two disks at a time, or the complex cavity 270 may fit two consequently spaced disks at one time. Such variations are understood to be included within the scope of this application.

For one embodiment, the top of the game 200 also includes a display area 280. For one embodiment, the display area 280 is a mechanical counter that counts the number of movements made by the disks. Towers of Hanoi is a mathematical game, in which the optimal number of movements to solve the puzzle is known. Therefore, a counter counting the number of movements may be useful. It permits the user to know whether he or she has achieved the theoretically derived optimal number of movements. Alternatively, the display area 280 may be another type of display. For example, the display 280 may be used to illustrate possible moves, instruct a user on an optimal next move, or display a full sequence of moves that leads to a solution. For one embodiment, the display 280 may further be used to display background information about this game. For one embodiment, the display 280 may demonstrate the mathematical analysis of the game. Alternative uses for the display 280 may be found.

For one embodiment, the game is implemented in plastic, with bright primary colors designed to appeal to children. For one embodiment, each of the disks is a different color. For one embodiment, the disks are the colors of the rainbow, in the proper order. Thus, for example, the colors of the disks in order are from smallest to largest are: red, orange, yellow, green, blue, indigo, violet.

Figure 3:
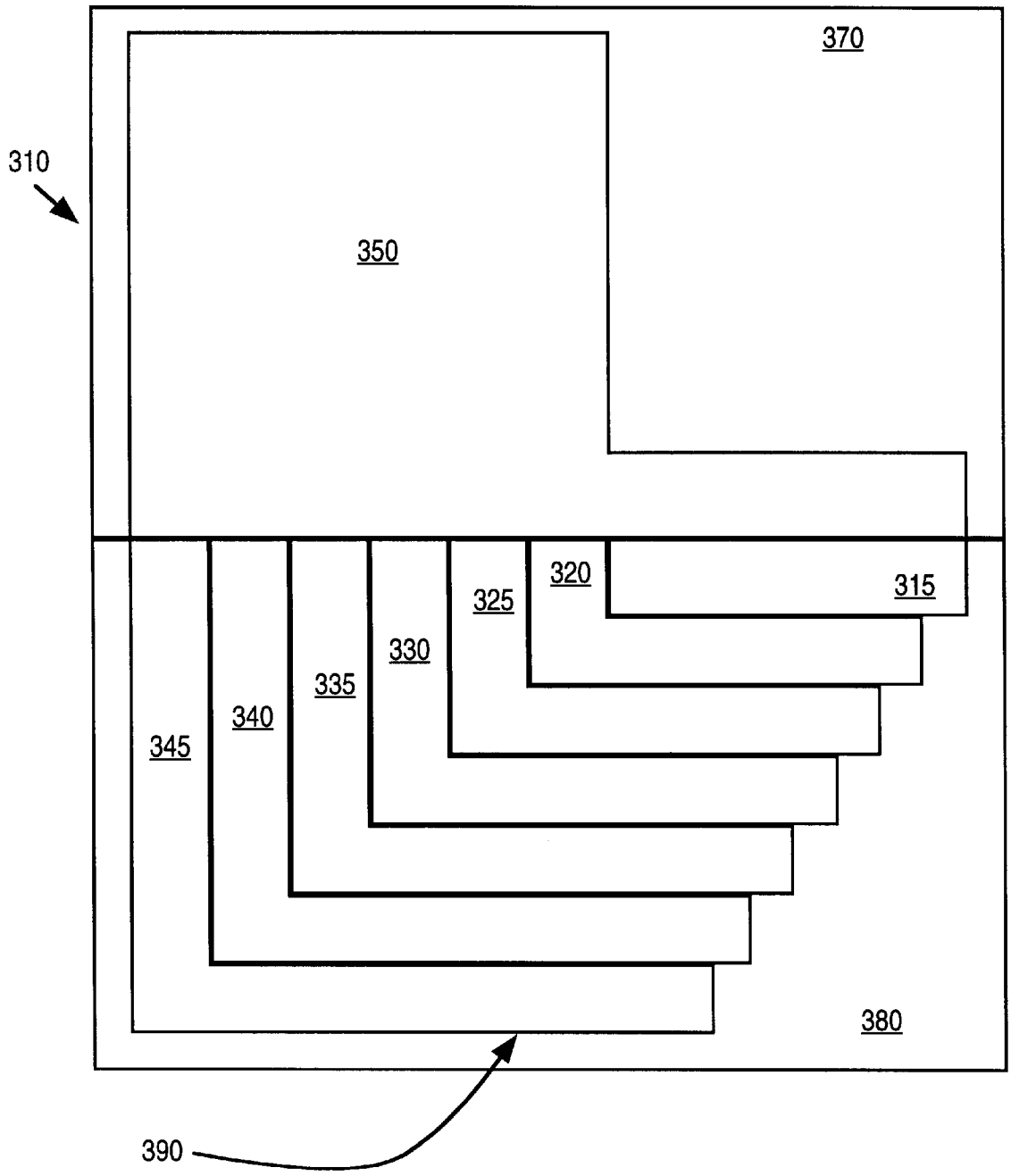
FIG. 3 is a side view of one embodiment of the game according to the present invention.

FIG. 3 illustrates one embodiment a side view of the body of the game. As discussed above, in a typical game there are seven disks. Thus, the side 310 includes seven disks 315–345. The side 310 includes an upper part 370 and lower part 380. The lower part 380 includes a cavity shaped to fit all of the seven disks 315–345. Each of the disks nests in the next largest disk, with the largest disk 345 resting against the bottom of the cavity 210. Each of the disks, excluding for one embodiment the smallest disk 315, is in an L-shape. Each of the L-shaped disks 320–345 have a vertical leg of the same width. The vertical legs of the L shaped disks 320–345 all end at the same level. Thus, the smallest L-shaped disk 320 has a short vertical portion, while the largest L-shaped disk 345 has a long vertical portion. For one embodiment, the length and width of each of the horizontal legs of each L-shaped disk 320–345 is the same.

For one embodiment, the smallest disk 315 is a rectangular shape, and fits into the L-shape of the next larger disk 320. For one embodiment, the rectangular shape has a height which is the same as the height of the horizontal portions of the L-shaped disks 320–345, and a width the same as the width of the horizontal portions of the L-shaped disks 320–345.

Thus, excluding the smallest disk 315, the disks 320–345 together form a larger L-shape. The L-shape has a vertical portion that is low and wide, fitting the six L-shaped disks. The L-shape also has a horizontal leg having a step-like front. If the smallest disk 315 is included, the top of the entire nested set of disks 315–345 is level, with a step-like front.

For one embodiment, the cavity in the upper part 370 is shaped like an L. The vertical leg of the L has a height at least the height of the tallest disk 315. The width of the vertical leg of the L is the combined widths of all disks 315–345 which have a vertical component. The horizontal leg of the L is the height of the height of a single disk 315–345. The length of the horizontal leg of the L extends such that any one of the disks 315–345 may be moved to the cavity in upper part of the body. Of course, only the top disk in the lower part of the body may be moved to the cavity in the upper part.

For another embodiment, the top cavity may only include the horizontal leg of the L-shaped disk, allowing the disk in the top cavity to extend beyond the body 310.

Figure 4A:
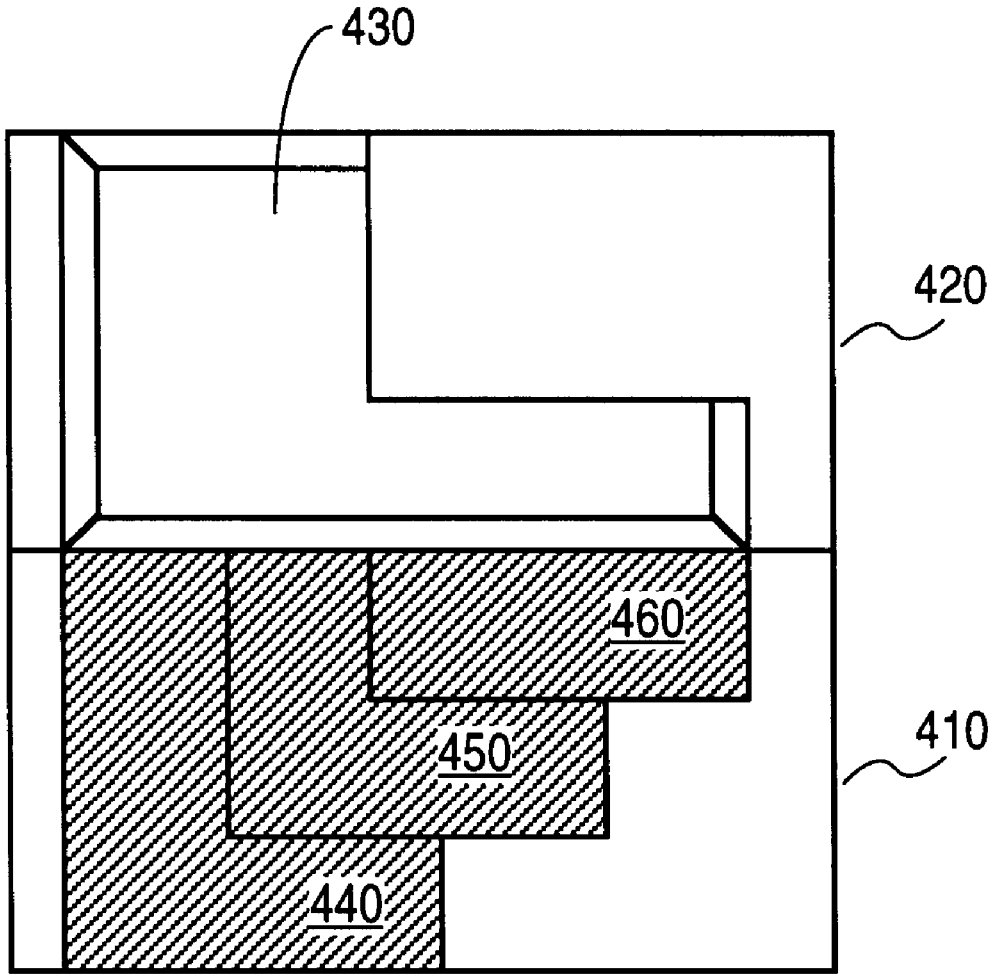
FIG. 4A is one embodiment of a three disk game, with all of the disks in a first position.

FIG. 4A illustrates a three disk game, with all of the disks 440, 450, and 460 in a first position. This is the beginning configuration of the game. It is also the end configuration of the game.

Figure 4B:
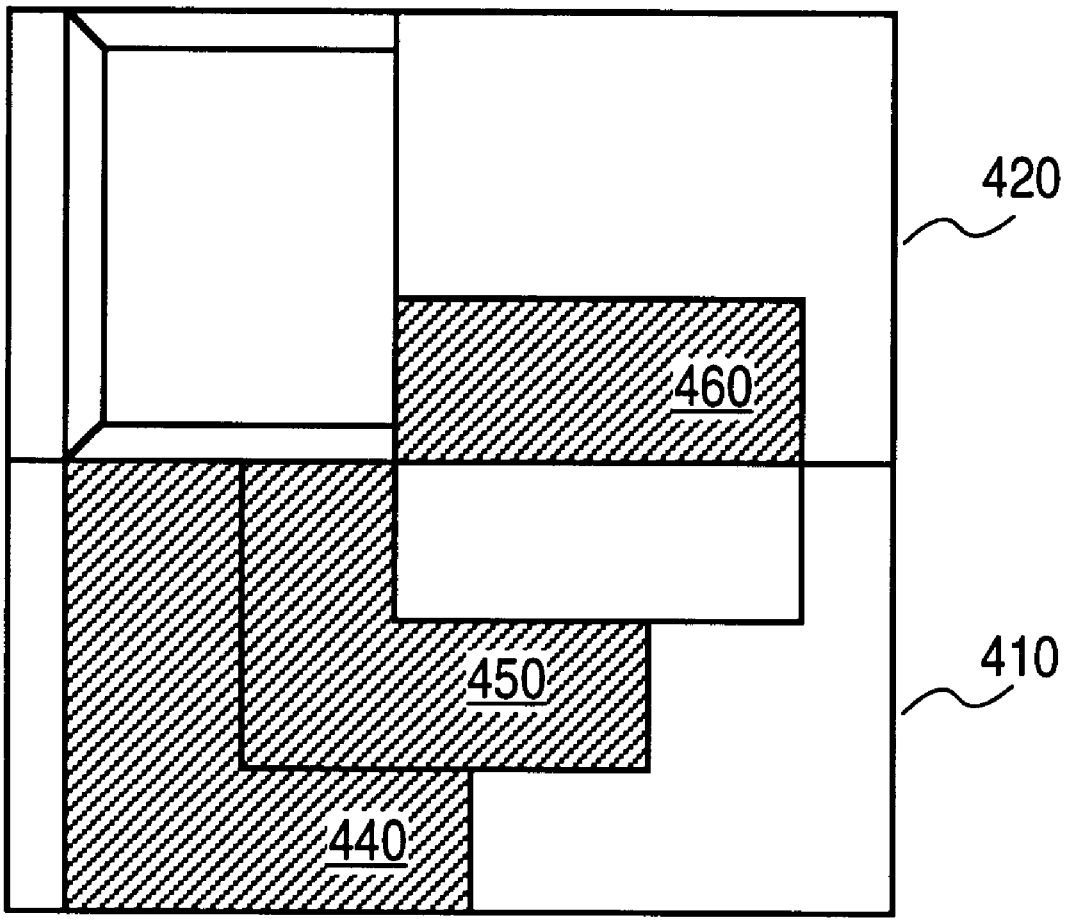
FIG. 4B is the game in FIG. 4A, with a first disk positioned for rotation.

FIG. 4B illustrates on other side of the game in FIG. 4A, with a first disk 460 positioned for rotation. As can be seen, the disk 460 is in the upper part 420 of the body. The upper part 420 may now be rotated with respect to the lower part 410. The disk 460 may then be placed in the lower part in another side of the body.

Figure 4C:
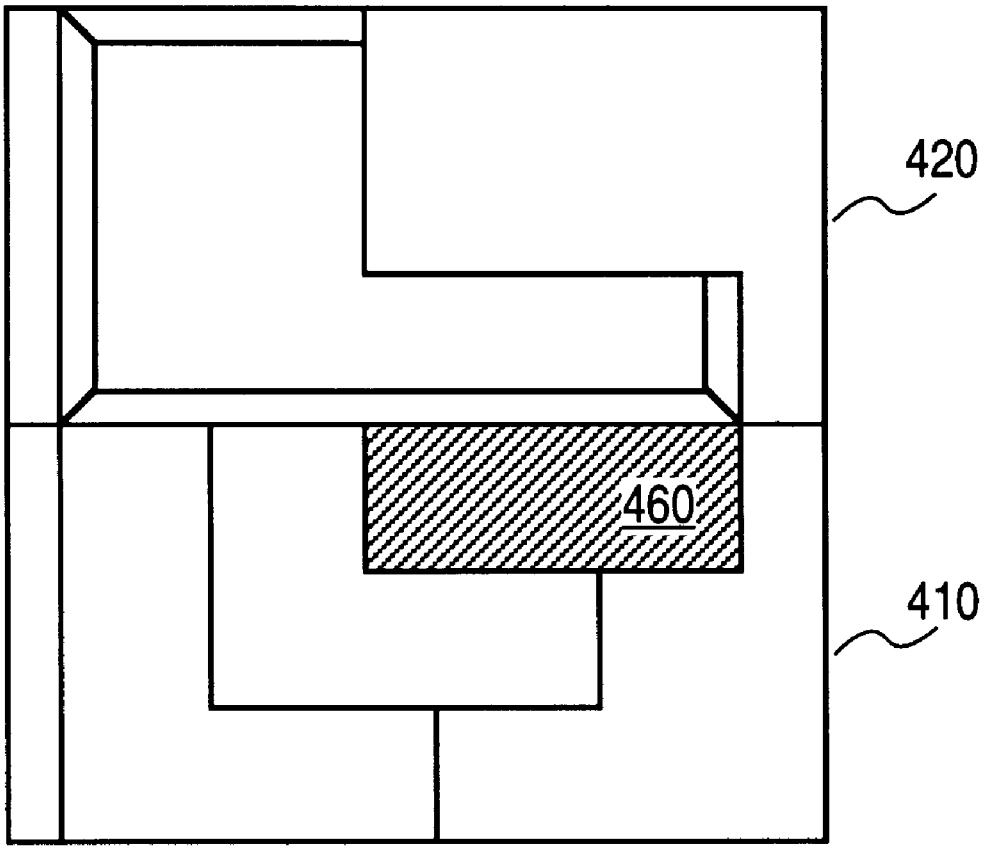
FIG. 4C is the game in FIG. 4A, with a first disk in a second position, and a second disk positioned for placement.

FIG. 4C illustrates another side of the game in FIG. 4A, with a first disk 460 in the lower part 410. The first disk 460 illustrated in FIG. 4B was rotated to a second side, and placed in the lower portion 410 of the body. The disk 460 rests on the edge of the cavity, floating above the empty slots. Note that the disk 460 always rests in "it's" own spot, whether or not there are other disks in the cavity.

Figure 4D:
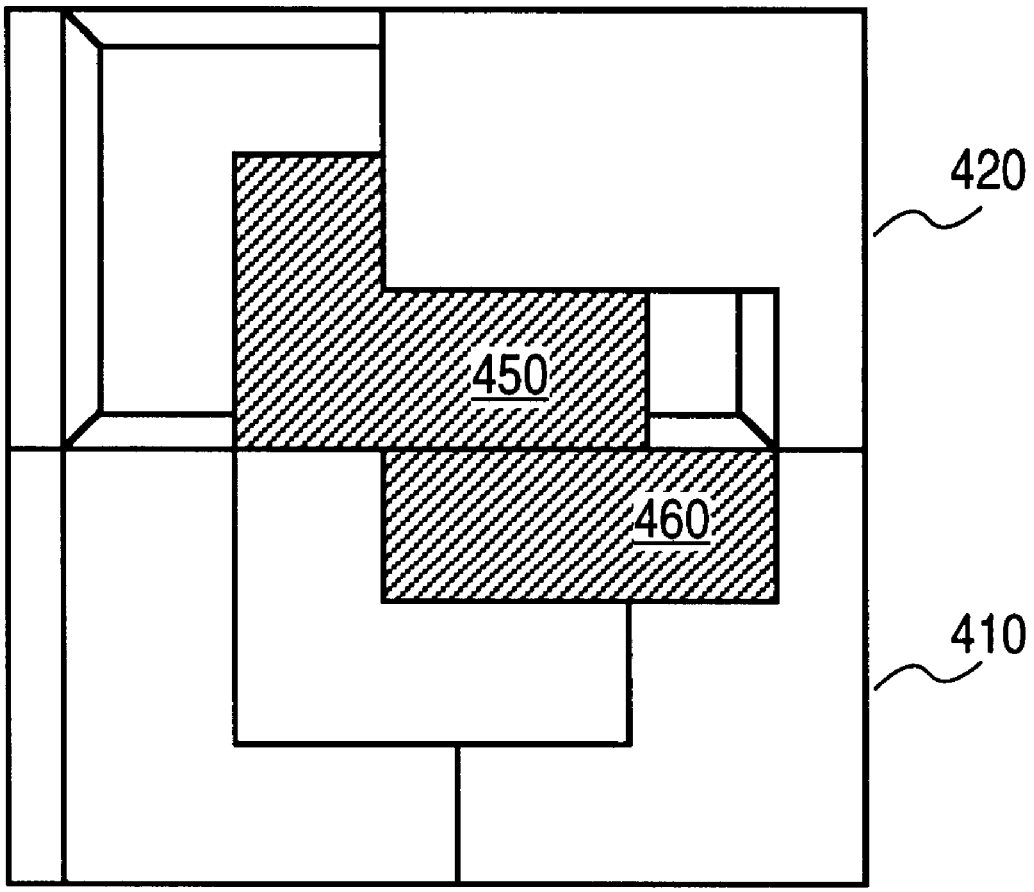
FIG. 4D is a side view of the game in FIG. 4A, with two disks in the second position.

FIG. 4D illustrates a side view of the game in FIG. 4A, with a second disk 450 in the upper portion 420 of the body. If, after the movement illustrated in FIG. 4C, the second disk 450 is moved into the upper part 420 and rotated, it would be in this configuration. Note that the second disk 450 can not be placed into the lower part of the body. This is one of the constraints of the game. A larger disk may not be placed on top of a smaller disk. This is enforced, as can be seen in FIG. 4D, by the configuration of the cavity in the lower part 410 of the body.

Figure 5:
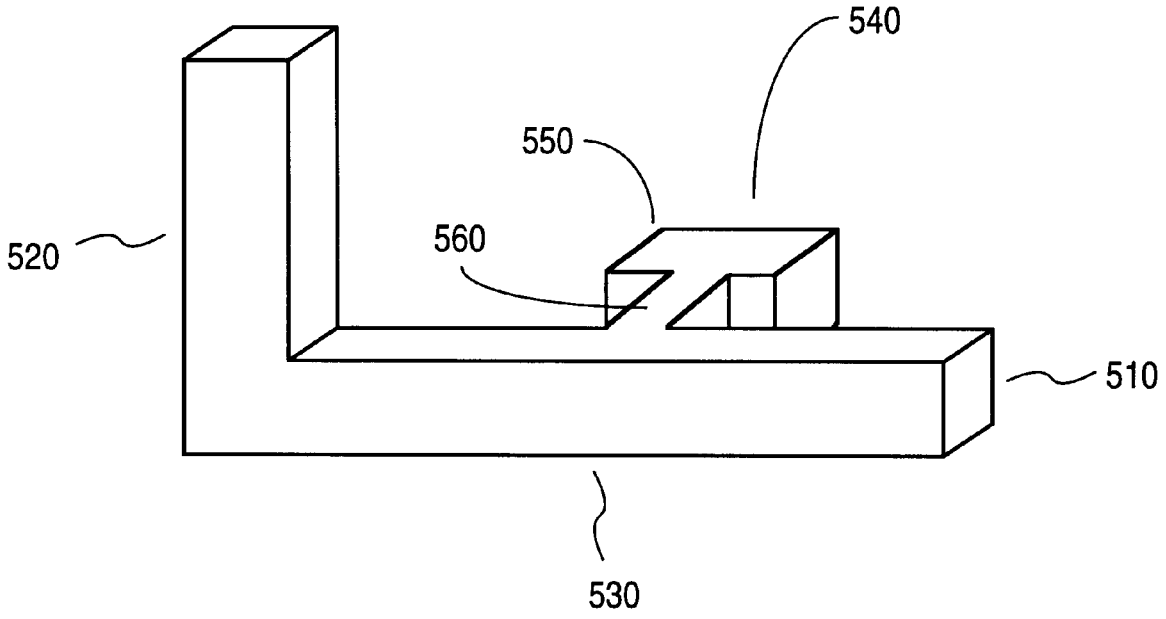
FIG. 5 is one embodiment of a single "disk" of the present invention.
Figure 10:
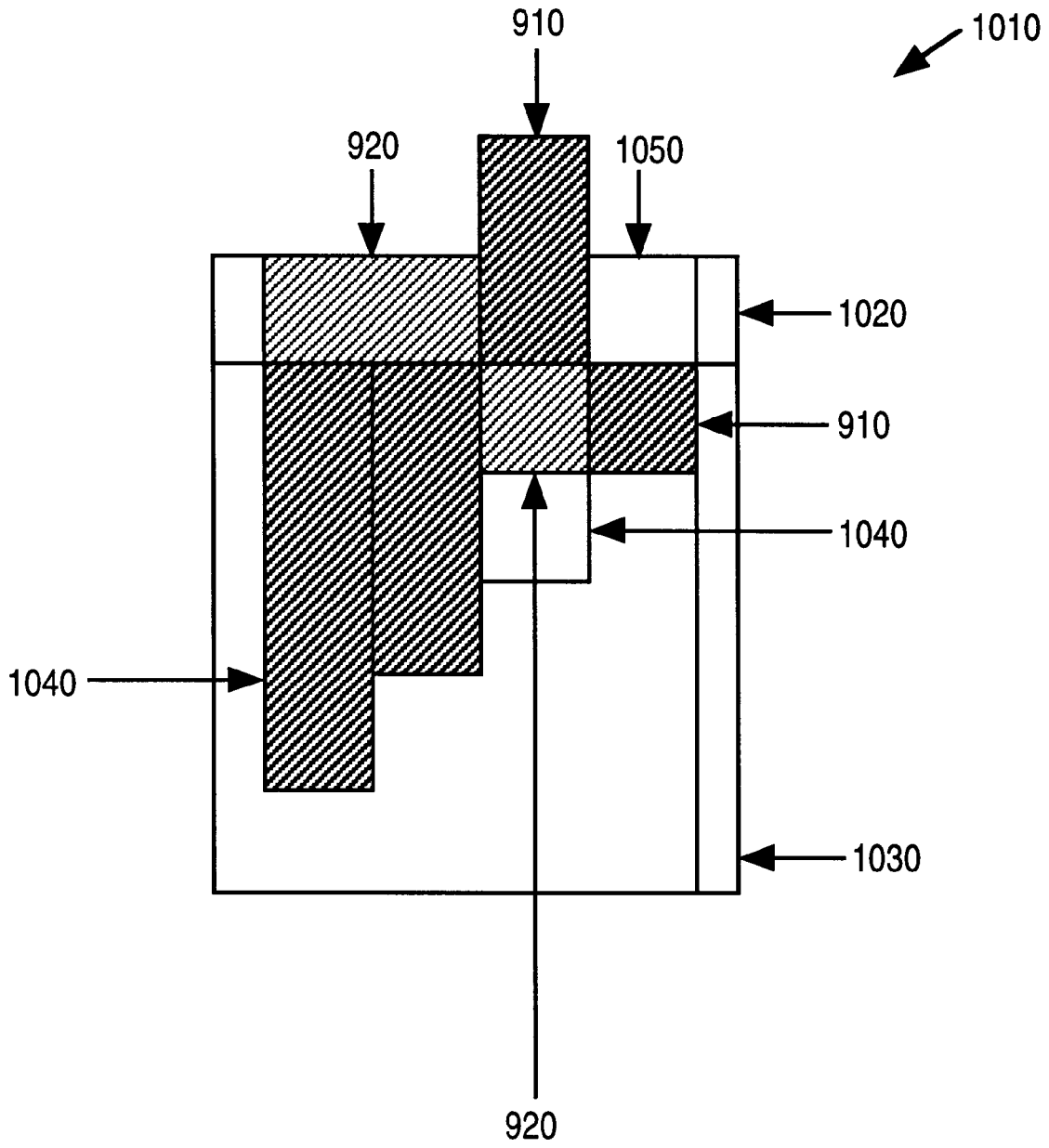
FIG. 10 is one embodiment of the game including the disk of FIG. 9.

FIG. 5 illustrates one embodiment of a single "disk" of the present invention. The L-shaped portion of the disk 510 is visible during game play. The disk has a horizontal portion 530 and a vertical portion 520. A cantilever 540 is coupled to the back of the disk 510. A cantilever 540 is a T-shaped element, having a head 550 and arm 560. The arm 560 is disposed within a groove in the body of the game. The head 550 is disposed within a cavity in the body of the game. The game body, shown in FIG. 10, is designed such that when a cantilever 540 is in the body, the disk can move vertically along the groove. Each disk has a similar cantilever. For one embodiment, a cantilever 540 is designed to be located at the same absolute position with respect to the body for each disk 510. That is, each disk has its cantilever coupled into the same groove.

Figure 6:
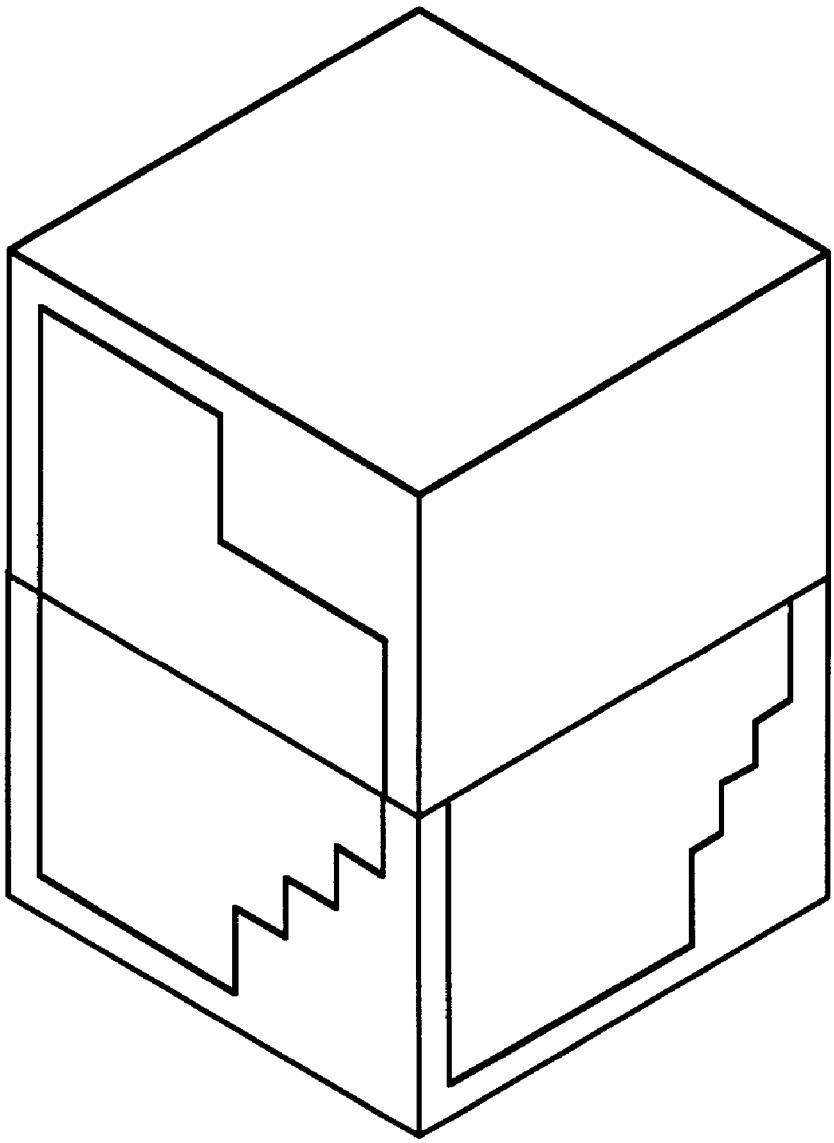
FIG. 6 is an other embodiment of the game according to the present invention, with four sides.

FIG. 6 illustrates an other embodiment of the game according to the present invention, with four sides. The present game may be played with a different number of sides and a different number of elements within the game. The mathematically optimal solution—the solution with the smallest possible of moves—is known for the three sided game but not known for the four sided game. There are known faster solutions for the four sided games than for the three sided game, but the mathematically proven fastest solution is not known.

For another embodiment, the game has four sides, and has two sets of disks with different color schemes. Thus, for example, the first side may have seven blue disks while the second side has seven red disks. The object of the game, in this embodiment, is to place all of the blue disks in one stack and all of the red disks in another stack.

Figure 7:
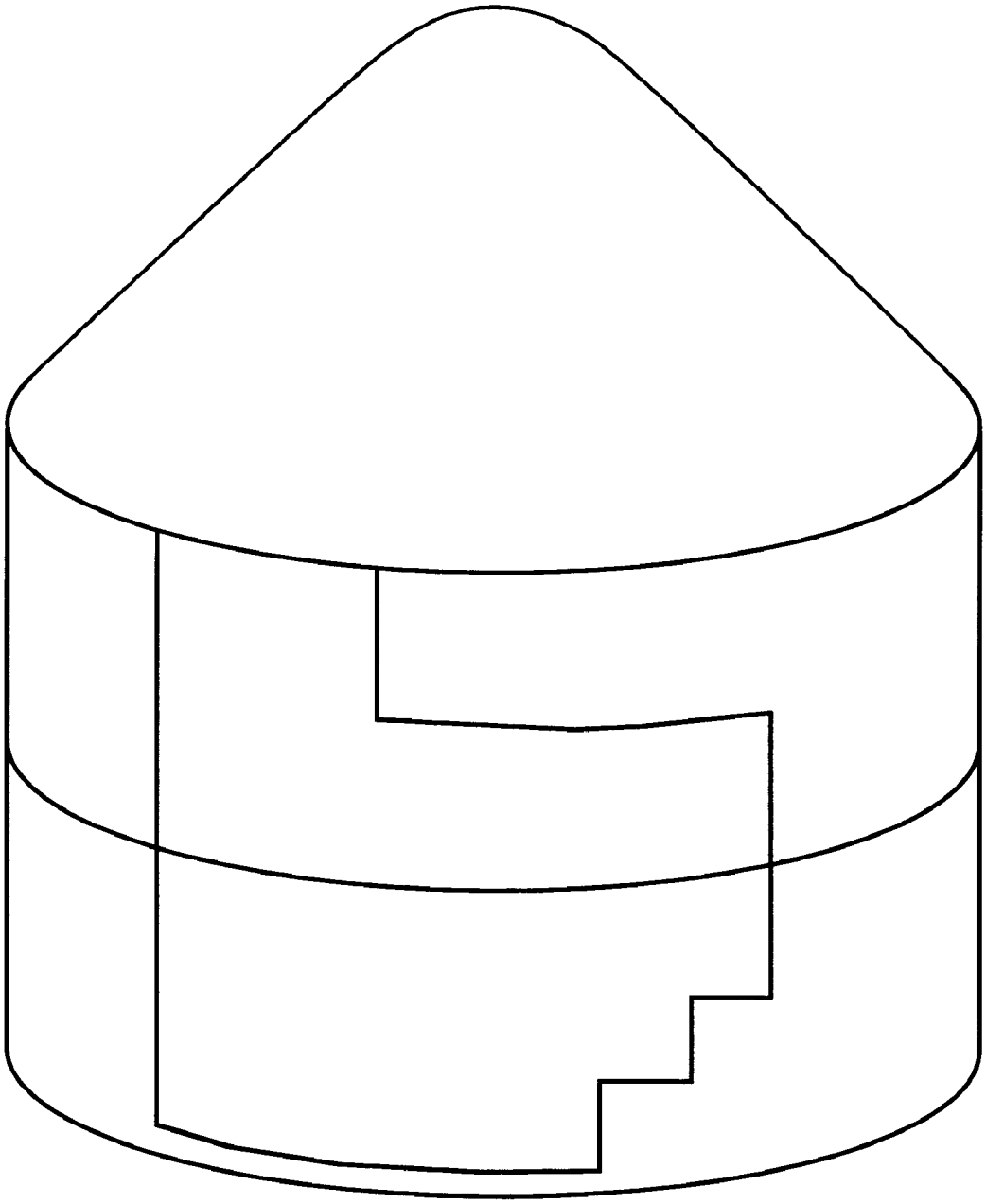
FIG. 7 is an other embodiment of the game according to the present invention, with rounded edges.

FIG. 7 illustrates an other embodiment of the game having rounded edges. The configuration of the elements is similar to the game illustrated in FIG. 2. However, for aesthetic reasons, the edges are rounded, and the elements are similarly rounded. This may increase the appeal of the game. Other changes, such as further curvature of the body, the addition of edges, additional sides, using different shapes for the disks, etc. may be made without changing the game. Alternative disk shapes may be implemented if the shapes maintain the game rules.

Figure 8:
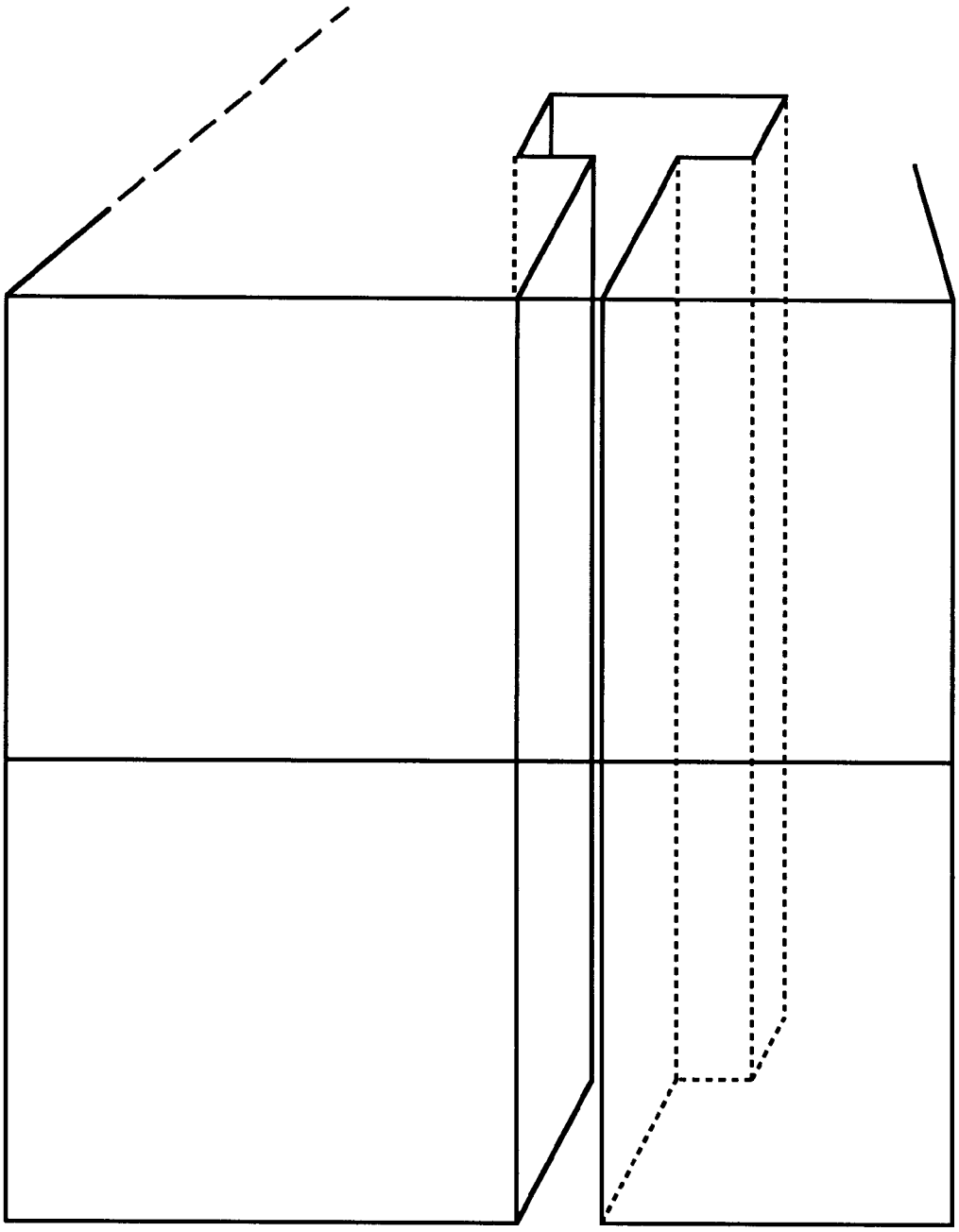
FIG. 8 is one embodiment of the body of the game, including the groove into which disk attachments fit.

FIG. 8 illustrates the body of the game, including the groove into which disk attachments fit. The grooves permit free movement of the disks. Alternative methods of attaching the disks into the body of the game may be used. For example, each disk may include a back plane having a uniform width. This back plane would be attached to the back of each disk. The edges of the back plane may be fixed behind an edge or lip of the body. In this way, the disks would be movably fixed into the body. Alternative means of fixing the disks into the body may be used.

Figure 9:
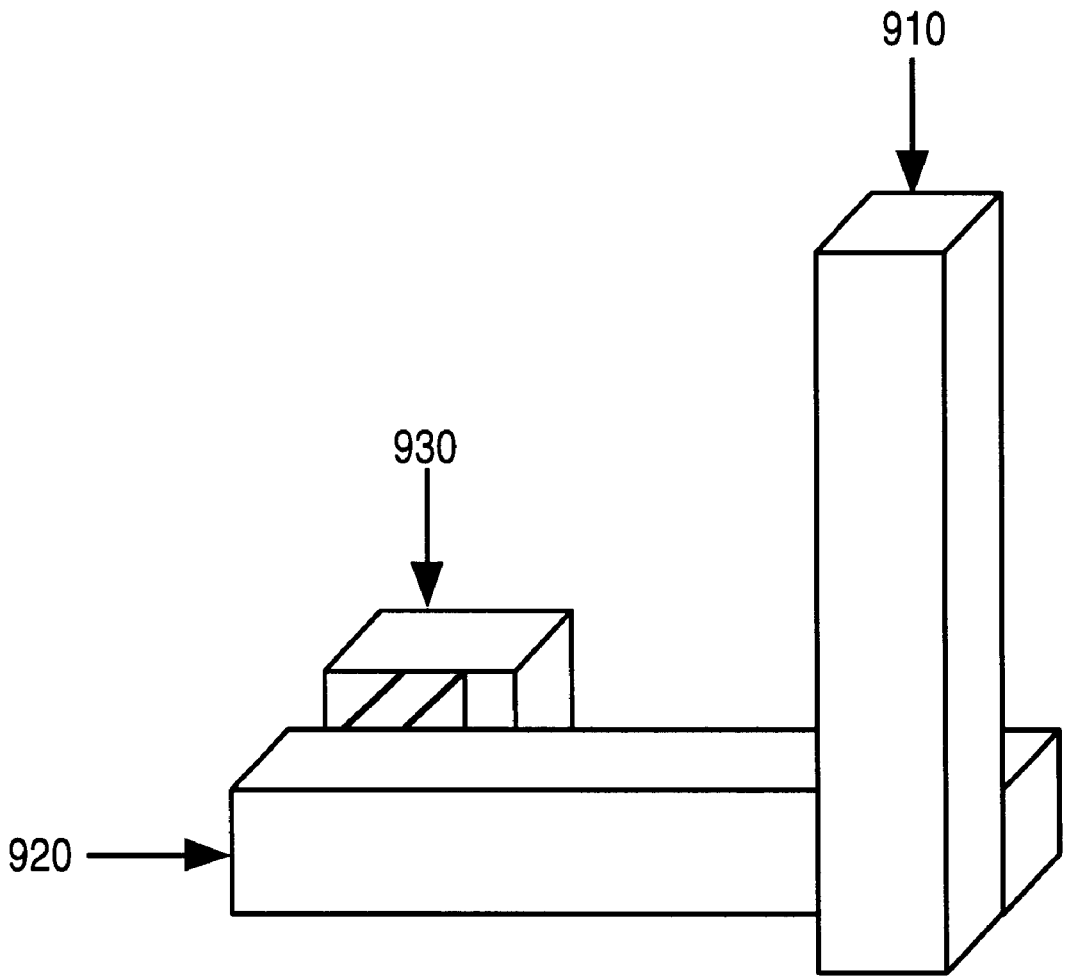
FIG. 9 is another embodiment of a disk.

FIG. 9 is another embodiment of a disk. The disk includes a front element 910, and a back element 920, which is in a different plane from the front element 910. The disk forms the mirror image of an L-shape, with the horizontal and vertical legs in different planes. The disk further includes a cantilever element 930 for fastening the disk into the game. For one embodiment, the cantilever element 930 is a T-shape. For another embodiment, the cantilever element 930 may be another shape.

For one embodiment, the back element 920 is horizontal. For one embodiment, the size of the back element 920 is inversely related to the size of the front element 910. Thus, for example, the smallest disk, having the smallest front element 910, has the longest back element 920, while the largest disk, having the largest front element 910, has a back element that is only as wide as the width of the front element 910. This permits a reduction in the size of the game, as illustrated in FIG. 10.

FIG. 10 is one embodiment of the game including the disk of FIG. 9. The upper part 1020 of the game 1010 includes a slot for receiving the back element 920 of each disk. The front element 910 of the disk extends above the upper part 1020 of the game 1010. FIG. 10 illustrates the game 1010 with one of the disks 910 located in the upper cavity 1050, for movement. The remaining disks are illustrated in the lower cavity 1040, which is designed to fit all of the disks. To achieve this configuration, first the smallest disk is moved to second side and then the second disk, shown in the upper part 1020, is moved to a third side. The smallest disk is returned to the first side, and the second disk is returned to the first side. The second disk can not be placed in the lower part 1030 at this point.

As discussed above, the cavity 1040 of the lower part 1030 is repeated in each of the other faces of the game. For one embodiment, the upper cavity 1050 is only in one face. In this way, one disk at a time can be moved. The cavity 1040, 1050 in the upper and lower parts is shaped to receive the front and back elements of the disks, and permit movement of one disk at a time from the lower cavity 1040 to the upper cavity 1050.

In the foregoing specification, the invention has been described with reference to specific exemplary embodiments thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

What is claimed is:

1. A multi-sided game including multiple sides and a plurality of moveable pieces comprising:

a first part including one side having a cavity shaped to fit any one of the plurality of moveable pieces at one time;

a second part rotatably coupled to the first part, the second part including a complex cavity in each of the multiple sides, the complex cavity shaped to fit each of the plurality of moveable pieces in a certain order;

the object of the game being to move each of the plurality of pieces from a first side in the second part to a second side in the second part.

2. The multi-sided game of claim 1, wherein each of the plurality of moveable pieces are of a different shape.

3. The multi-sided game of claim 2, wherein the moveable pieces are of different sizes.

4. The multi-sided game of claim 3, wherein the complex cavity has a top oriented toward the first part, and a bottom oriented toward a base of the game, and wherein the complex cavity is shaped to accept the plurality of pieces in order of size, such that a biggest piece is at the bottom and a smallest piece is at the top.

5. The multi-sided game of claim 4, wherein the complex cavity is shaped such that a bigger piece may not be placed on a smaller piece within the complex cavity.

6. The multi-sided game of claim 1, wherein the plurality of moveable pieces comprise four pieces, and the multiple sides comprise three sides.

7. The multi-sided game of claim 1, wherein the plurality of moveable pieces comprise seven pieces, and the multiple sides comprise three sides.

8. The multi-sided game of claim 1, wherein the first part and the second part together form a body, and the body comprises hard plastic.

9. The multi-sided game of claim 8, wherein the plurality of moveable pieces are flat plastic pieces that are movably, but not removably, fitted into the cavities of the body.

10. The multi-sided game of claim 1, further comprising a counter for counting the number of moves made by a player in moving the plurality of pieces from the first side to the second side.

11. The multi-sided game of claim 10, wherein the counter further includes a comparison with an optimal number of moves.

12. The multi-sided game of claim 1, wherein the game further includes a top and a bottom, and further comprising a display.

13. The multi-sided game of claim 12, wherein the display is for displaying a number of moves made by a player.

14. The multi-sided game of claim 12, wherein the display is for displaying an optimal set of moves for the game.

15. A game including a body having a number of sides and a plurality of pieces disposed within the body, the body comprising:

a first part and a second part, the first part rotatable with respect to the second part;

a first cavity included in one side of the first part, the first cavity shaped to removably accept any one of the plurality of pieces at one time;

complex cavities included within a plurality of the sides of the second part of the body, the complex cavities shaped to removably accept all of the plurality of pieces in a certain order;

wherein the first cavity in the first part may be aligned with one of the complex cavities in one side of the second part, such that any one piece of the plurality of pieces may be moved from the first part to the second part or vice versa.

16. A mechanical implementation of a Tower of Hanoi game, comprising a goal to move a stack of multiple pieces from one side to another side, wherein no larger piece may be placed on a smaller piece, and there are at least three sides, comprising:

a first part designed to receive the stack of multiple pieces in the at least three sides of the game; and a second part rotatably coupled to the first part, the second part designed to receive any one piece of the multiple pieces, and move the one piece to another side;

such that the mechanical game can only be completed by following the rules of the Tower of Hanoi game, whereby a player not familiar with the rules can play the game.

17. A game comprising:

a body having a plurality of sides including an upper part and a lower part rotatably coupled to each other;

a plurality of pieces disposed within the lower part such that the plurality of pieces fit in a certain order into each of the plurality of sides, the plurality of pieces moveable by moving to the upper part, and rotating the upper part with respect to the lower part;

the game having a goal to move the plurality of pieces from one side in the lower part to another side, wherein the game can only be played by following rules of a Tower of Hanoi game, whereby a player unfamiliar with the rules of the Tower of Hanoi game can play the game.

18. A game comprising:

a body having a plurality of sides, the body including an upper part and a lower part rotatable with respect to each other;

a plurality of pieces disposed within the body, an object of the game being to move the pieces from one side to another side, wherein the game automatically implements rules of a Tower of Hanoi game.

19. The game of claim 18, wherein the rules comprise a rule that a larger piece may never be placed on a smaller piece.

20. The game of claim 18, wherein the body forms three rectangular faces coupled by a triangular top and a triangular bottom.

* * * * *